US005593087A

United States Patent [19]

Ross et al.

[11] Patent Number: 5,593,087

[45] Date of Patent: Jan. 14, 1997

[54] OPEN-TOP CONTAINER WITH INTEGRAL END PANELS

[75] Inventors: John A. Ross; James C. Fogle, both of Marietta, Ga.

[73] Assignee: Riverwood International Corporation, Atlanta, Ga.

[21] Appl. No.: 518,695

[22] Filed: Aug. 24, 1995

[51] Int. Cl.[6] ..... B65D 5/32; B65D 21/032

[52] U.S. Cl. ..... 229/199; 229/23 R; 229/109; 229/919

[58] Field of Search ..... 229/23 R, 109, 229/110, 915, 916, 919, 199; 220/416; 206/509, 511, 512

[56] References Cited

U.S. PATENT DOCUMENTS

| | | | |
|---|---|---|---|
| 2,072,753 | 3/1937 | Ikeda et al. | 229/113 |
| 2,138,112 | 11/1938 | Means et al. | 229/112 |
| 2,401,742 | 6/1946 | Bentham | 229/23 R |
| 2,646,915 | 7/1953 | Bockmann | 229/113 |
| 3,428,234 | 2/1969 | DuBarry, Jr. | 229/23 R |
| 3,863,831 | 2/1975 | Wozniacki et al. | 229/23 R |
| 3,905,541 | 9/1975 | Paxton | 229/23 R |
| 4,175,691 | 11/1979 | Cornell et al. | 229/23 R |
| 4,709,852 | 12/1987 | Stoll | 229/23 R |
| 4,884,739 | 12/1989 | Nederveld | 229/23 R |
| 5,116,290 | 5/1992 | Ross | 229/23 R |
| 5,316,207 | 5/1994 | Ross et al. | 229/23 R |
| 5,361,974 | 11/1994 | Earl et al. | 229/23 R |
| 5,361,976 | 11/1994 | Blomfield | 229/919 |

*Primary Examiner*—Gary E. Elkins

[57] ABSTRACT

A container formed by wrapping a slotted flexible sheet about rigid end panels having corner projections that extend through the slots. The end panels are formed by a flap foldably connected to the sheet which may be reinforced by other connected flaps. Additional reinforcement may be provided by end panel stiffener inserts. Stacking projections on the end panels extend through slots in the flexible sheet to maintain the sheet in place.

19 Claims, 6 Drawing Sheets

OPEN-TOP CONTAINER WITH INTEGRAL END PANELS

FIELD OF THE INVENTION

This invention relates to packaging and shipping containers which need not be fully enclosed but must be sturdy enough to protect the contents, typically produce, during handling and shipment. More particularly, the invention relates to a container of this type which includes integrally formed end panels.

BACKGROUND OF THE INVENTION

Articles such as produce ideally should be packaged in containers which protect the contents against bruising or other damage during shipment and handling. The containers should also present an appealing appearance so that they can be used as retail packages after reaching their final destination, and should be economical as well.

One type of container used to package produce is comprised of separate rigid end panels about which a flexible cover sheet is wrapped to form the bottom, side and top panels. The end panels include stacking projections on their upper or lower edge and stacking recesses on their opposite edge. When the containers are stacked, the projections from one container fit into the recesses of the next higher or lower container. The flexible sheet includes slots for receiving the stacking projections and the corners of the end panels. Means are also provided on the end panels for holding the ends of the sheet in place. Typically, the ends of the sheet may overlap to form a fully enclosed container or they may be spaced from each other to provide a partially open top panel. The containers permit ready circulation of air to maintain the produce fresh and they can also serve as retail packages after reaching their final destination.

The end panels are typically formed of thick paperboard, pressed board or other readily available economical rigid material, while the flexible cover sheets are typically formed of paperboard of a thickness normally used in the manufacture of carriers from foldable paperboard blanks. Due to strength requirements the thickness of the end panels is typically several times greater than the thickness of the cover sheet. This arrangement requires a separate supply of the relatively expensive end panels which drives up the cost of the containers. In addition, it restricts the application of printing or other indicia to the cover sheet, resulting in plain end panels which prevent the container from having an overall integrated appearance.

A main object of the invention is to provide a produce container which makes use of the basic design concept referred to above but is not restricted to an end panel design of the type described. Another object is to provide such a container with strengthened side panels to further improve the ability of the container to resist loading and handling stresses.

BRIEF SUMMARY OF THE INVENTION

The improved container of the invention is based on the type of container discussed above, and includes bottom and side panels formed from a flexible sheet extending between spaced relatively rigid end panels which have upper corner areas and an upwardly extending projection inwardly spaced from each upper corner. The upper corner areas extend through slots in sloped portions of the side panels, and a top panel segment extending inwardly from each sloped portion is secured to the end panel projections. In accordance with the invention, each end panel includes an end panel flap connected by a fold line to the bottom panel and extending upwardly for substantially the entire height of the end panels.

The end panels are given sufficient strength and rigidity by various means of reinforcement. In one arrangement additional reinforcing plies are connected to the end panel flap and folded flat against the end panel flap prior to attaching the flexible sheet to the end panel projections. If necessary, an additional stiffener may be inserted between the folded flaps. In another arrangement a reinforcing web is glued to the end panel flaps.

The side panels and top panel segments of the container preferably are of two-ply construction to resist crushing or bowing during use, but may also be of single-ply construction is desired.

These and other features and aspects of the invention, as well as its various benefits, are made more clear in the detailed description of the preferred embodiments which follows.

DETAILED DESCRIPTION OF THE PREFERRED EMBODIMENTS

Figure 1:
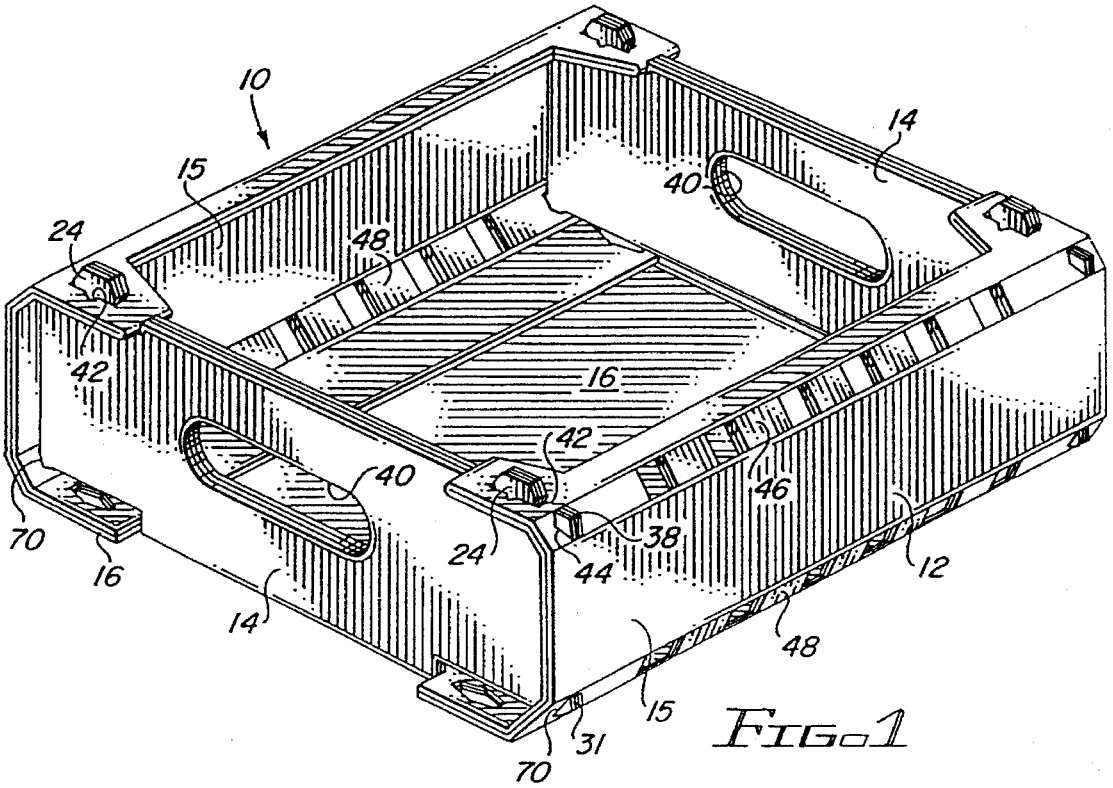
FIG. 1 is a pictorial view of one embodiment of the container of the invention.

Referring to FIG. 1, a container 10 of the type embodying the concepts of the invention is comprised of a flexible cover sheet 12 and rigid end panels 14. The cover sheet forms the side panels 15 and the bottom panel 16. As explained in more detail later, substantial portions of the bottom panel are comprised of a single ply of the cover sheet, while the side panels and adjacent portions of the bottom panel are comprised of two plies.

Figure 2:
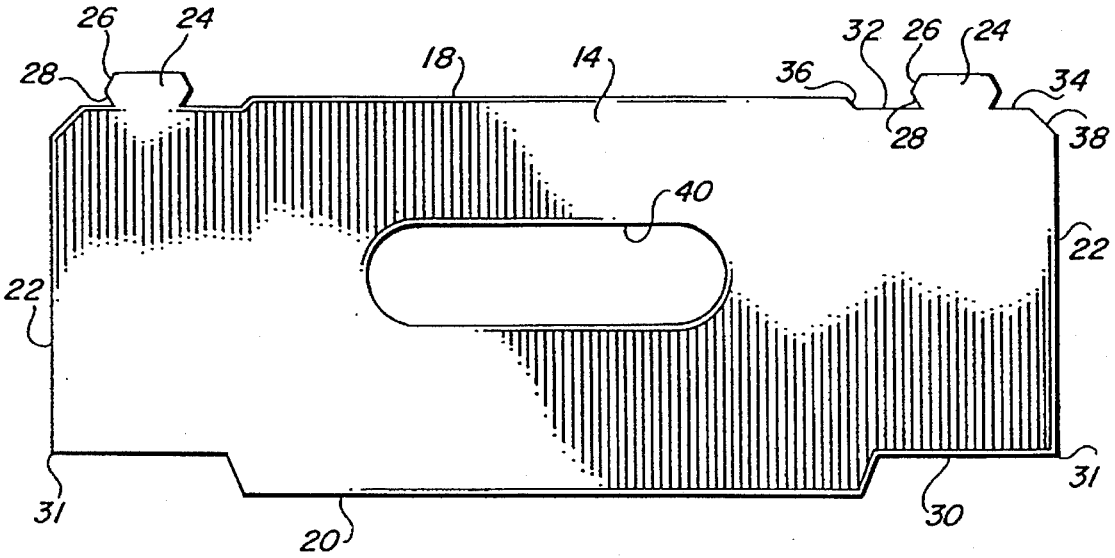
FIG. 2 is an elevation of an end panel of the container.

The end panel shown in FIGS. 1 and 2 is of generally rectangular shape, having upper and lower edges 18 and 20, respectively, and side edges 22. Projecting upwardly from the end panel are two spaced stacking projections 24 having side edge portions 26, which taper outwardly to a point slightly above or approximately on the plane of the upper panel edge 18, and side edge portions 28 which taper inwardly for a short distance from the lower end of the side edge portions 26. The end portions of the lower edge of the end panel are recessed, as indicated at 30, and terminate at lower corners 31. Adjacent each side of the projections 24 are recesses 32 and 34. Each of the recesses 32 and 34 has a side edge comprised of the tapered projection edge portion 28. The opposite edge 36 of the recess 32 is tapered outwardly, while the recess 34 ends at tapered shoulder 38. An opening 40 provides a hand grip for lifting the container and also allows air to flow into the container to keep packaged produce in fresh condition. As described in more detail below, the end panels are not separate panels as in conventional produce carriers, but are three-ply panels integrally formed with the cover sheet.

Referring back to FIG. 1, the stacking projections 24 extend up through slots 42 in the cover sheet to hold the ends of the cover sheet in place, while the tapered shoulders 38 extend through slots 44 in upper bevel panels 46. Lower bevel panels 48 extend between the side panels and the bottom panel and include end slots 70 through which the lower corners 31 of the end panels 14 extend.

Figure 3:
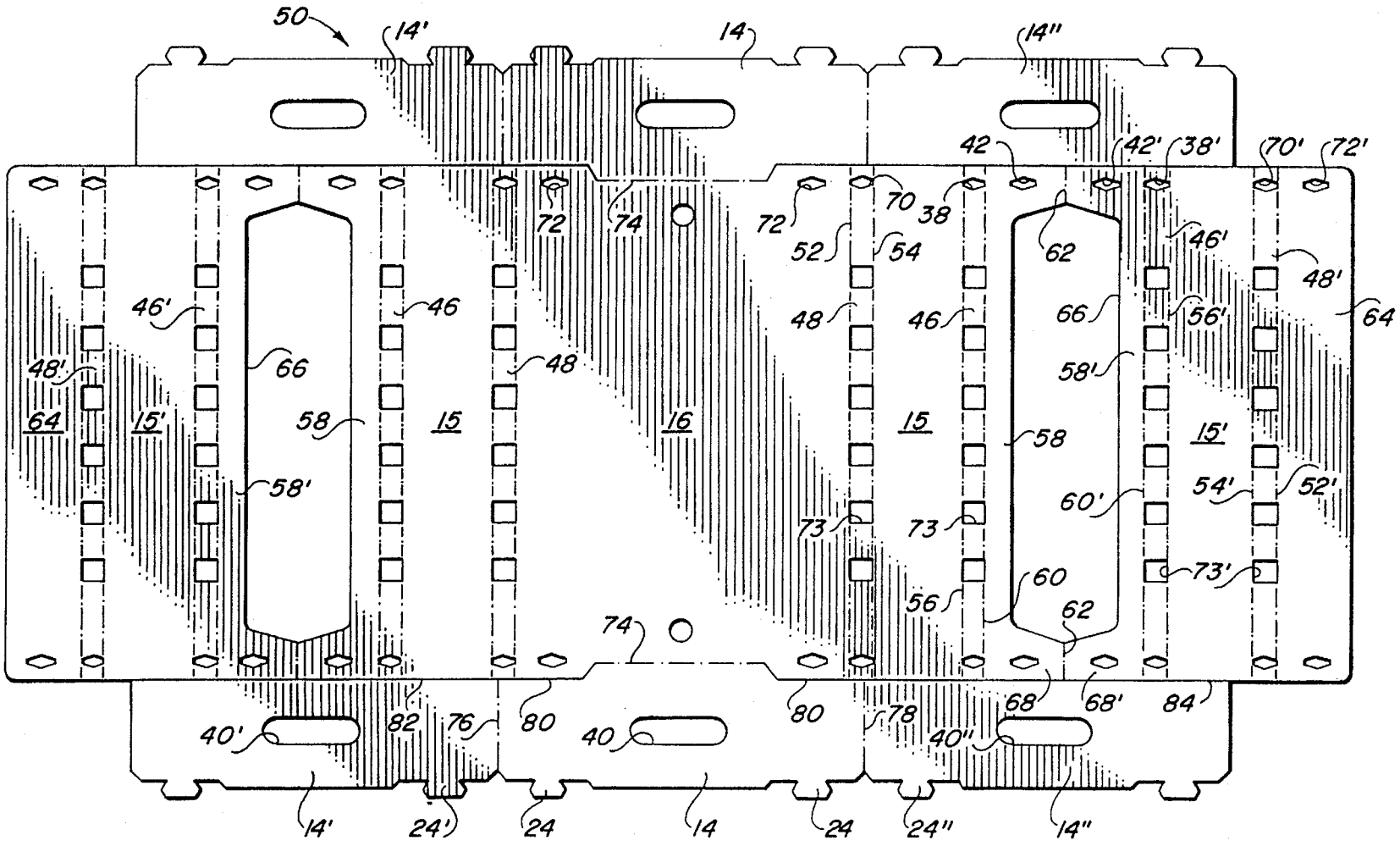
FIG. 3 is a plan view of the blank used in forming the container of FIG. 1.

The blank 50 used to form the cover sheet of the container of FIG. 1 is shown in FIG. 3, wherein similar reference numerals to those used in FIG. 1 denote similar elements. The blank includes a series of parallel fold lines which allow the sheet to be folded about the end panels to form the bottom, side, top and bevel panels of the container. Thus, the centrally located bottom panel section 16 is connected by fold lines 52 to lower bevel panel sections 48, which in turn are connected by fold lines 54 to side panel sections 15. Upper bevel panel sections 46 are connected to the side panel sections 15 by fold lines 56 and to narrow top panel sections 58 by fold lines 60. The top panel sections 58 are connected by fold lines 62 to top panel reinforcing sections 58' which are connected by fold lines 60' to upper bevel panel reinforcing sections 46'. Fold lines 56' connect the upper bevel panel reinforcing sections 46' to reinforcing side panel sections 15' and fold lines 54' connect the latter sections to lower bevel panel reinforcing sections 48'. The reinforcing sections designated by prime reference numerals are similar to the main panel sections bearing the same base reference numeral. A further partial bottom panel section 64 is connected to each lower bevel panel reinforcing section 48' by fold line 52'.

The central portions of the top panel sections 58 and the adjacent reinforcing top panel sections 58' are separated by cutouts 66, with the connected end portions of the adjacent sections functioning as locking tabs 68 and 68'. The locking tabs include the slots 42 and 42' for receiving the projections 24 of the end panels, and the upper bevel panel sections 46 and 46' include the slots 44 and 44' for receiving the upper corner shoulders 38 of the end panels. Similarly, the lower bevel panel sections 48 and 48' include the slots 70 and 70' for receiving the lower corners 31 of the end panels. In addition, slots 72 and 72' are provided in the bottom panel section 16 and the partial bottom panel section 64 to allow passage of the stacking projections of the next lower container in a stacked arrangement. A number of air flow openings 73 and 73' are provided in the bevel panel sections and the reinforcing bevel panel sections. These openings interrupt the fold lines of the bevel panel sections and by thus shortening the fold lines, also serve to facilitate bending the sections about the fold lines.

End panel flaps 14, shaped as described in connection with FIG. 2, are connected to the bottom panel section 16 by fold lines 74. Opposite ends of the flaps are connected by fold lines 76 and 78 to end panel reinforcing flaps 14' and 14". The reinforcing flaps are similar in shape to each other but differ slightly from the connected end panel flaps 14 in that the edge of the flaps 14 corresponding to the bottom edge of the end panels is shaped as illustrated in FIG. 2, with the lowermost edge being formed by the fold line 74 and the recessed portions being formed by slits 80 separating the flap 14 from the bottom panel section 14. The edges of the end panel flaps 14' and 14" corresponding to the lower edge of the end panels are separated from the adjacent portions of the blank by straight slits 82 and 84 which are continuations of the slits 80. The reinforcing flaps 14' and 14" include handle openings 40' and 40", respectively, which are of the same shape and size as the handle openings 40.

Figure 4:
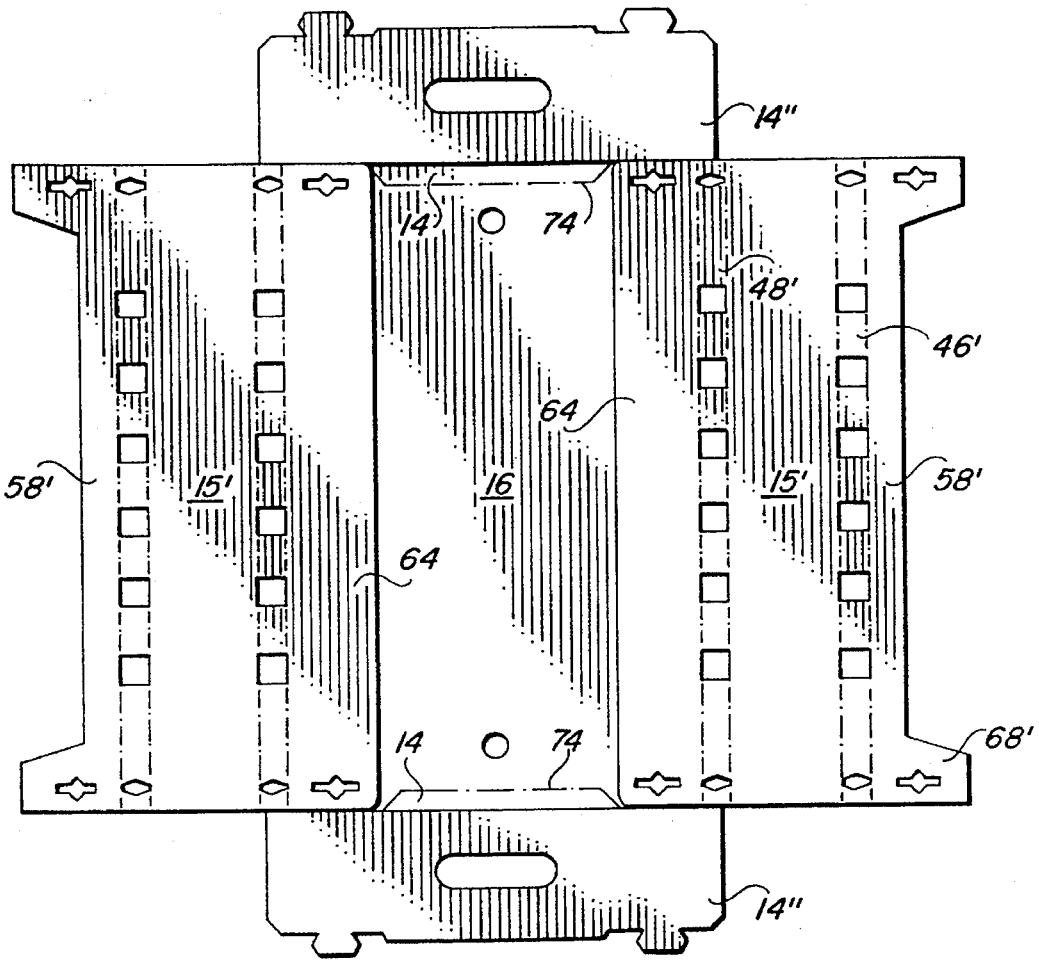
FIG. 4 is a plan view of the blank of FIG. 3 after initial folding steps have been completed.

To fabricate the container of FIG. 1, glue is applied to the reinforcing side panel sections 15' the upper and lower bevel panel reinforcing sections 46' and 48' and the bottom panel reinforcing sections 64. The glued sections are then pivoted about the fold lines 62 and adhered to their corresponding panel sections. The reinforcing end panel flaps 14' and 14" are then sequentially pivoted about their fold lines 76 and 78, in any order, so that one of them lies flat against the end panel flap 14 and the other lies flat against the first-folded reinforcing end flap. The blank at this point appears as in FIG. 4, which shows the reinforcing end flap 14" as having been last folded. The various fold lines of the folded sections overlie their corresponding fold lines.

After folding the end panel flaps about the fold lines 74 to their upright position, the lower bevel panel sections, the side panel sections and the upper bevel sections are then folded about their fold lines to their final configuration so that the shoulders 38 of the reinforced end panels 14 extend through the slots 44 in the upper bevel panel sections 46, the lower corners 31 of the end panels extend through the slots 70 in the lower bevel panel sections 48 and the stacking projections 24 extend through the slots 72 in the locking tabs 68 to form the container of FIG. 1. It is not necessary for the end panel flaps to be glued together since the tight fit of the stacking projections and the slots in the locking tabs locks the assembly in place. The recesses in the end panel flaps 14 provide space for the stacking projections of the next lower container in a stack to project up through the slots 72 in the bottom panel. Since the lower edges of the end panel reinforcing flaps 14' and 14" do not extend down into the recessed portions of the flap 14, they do not extend into the space to be occupied by the stacking projections of the next lower container in a stack and thus do not interfere with the ability to stack the containers.

Figures 5, 8:
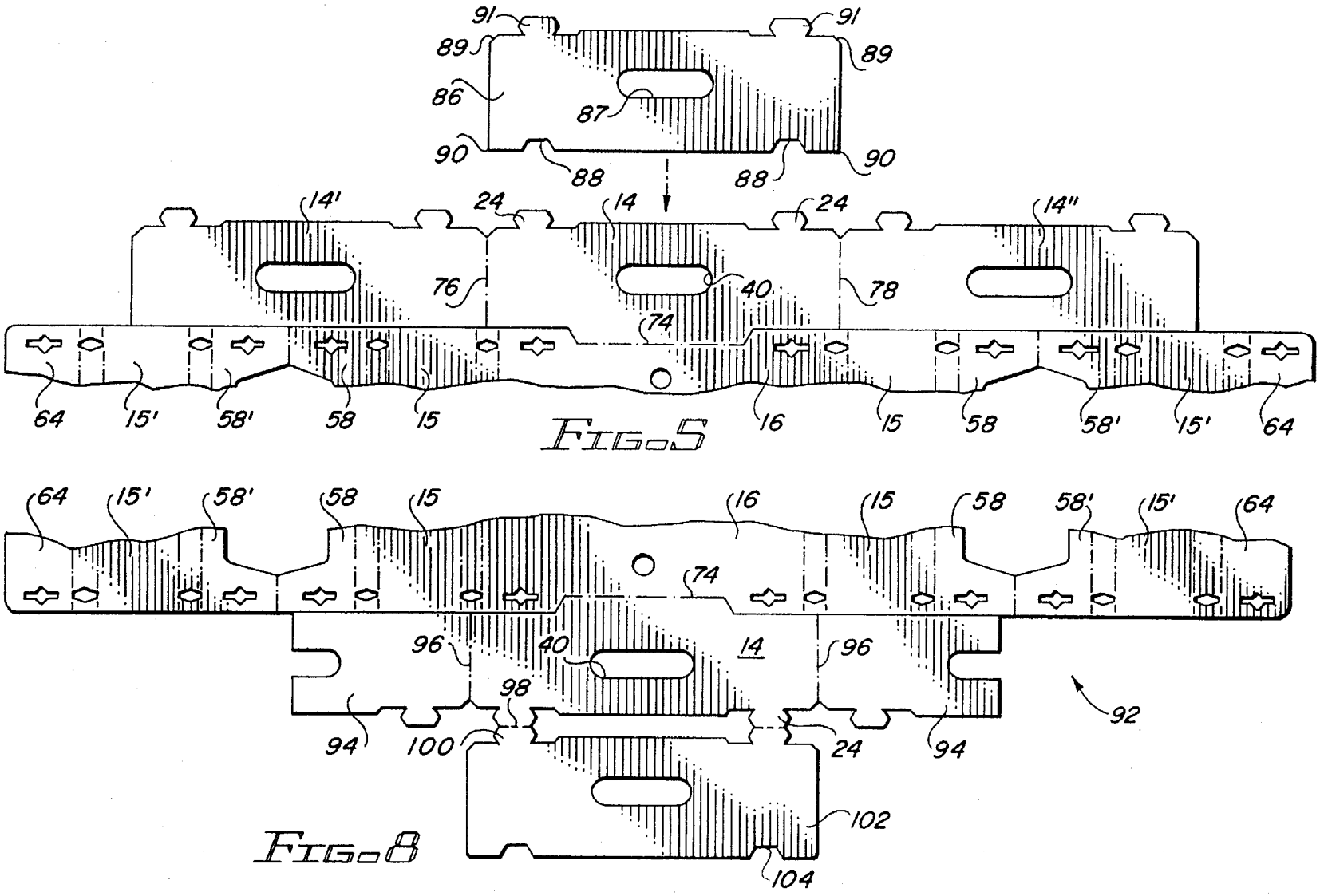
FIG. 5 is a partial plan view of the blank and an end panel insert employed in a modified arrangement.
FIG. 8 is a partial plan view of another blank for forming a modified container.

It will be appreciated that the reinforcing sections provide a two-ply construction for the top panel strips, the side panels, the bevel panels and part of the bottom panel, while the end panel flaps provide a three-ply construction for the end panel structure. If desired, the bottom panel reinforcing sections 64 could be enlarged so as to meet at the center of the container to provide a two-ply structure throughout the entire bottom panel as well. Even though the end panels are formed from relatively thin paperboard compared to the relatively thick, rigid end panels of the prior art, this construction provides end panel strength which is normally adequate to resist the stresses to which it is subjected during use. If, however, it is found that the end panels require even greater strength, as when the container is expected to be subjected to excessively high forces or when the cover sheet of the container is of very low caliper, the end panels may be further stiffened by employing a stiffener insert. Such an arrangement is illustrated in FIG. 5, wherein an insert 86 is indicated by the direction arrow as being moved onto the flap 14 prior to folding the flaps 14' and 14". The resulting end panel is shown in FIG. 6 to include the stiffener insert 86 as the second ply, between the outer ply 14 and the inner plies 14' and 14".

Figure 7:
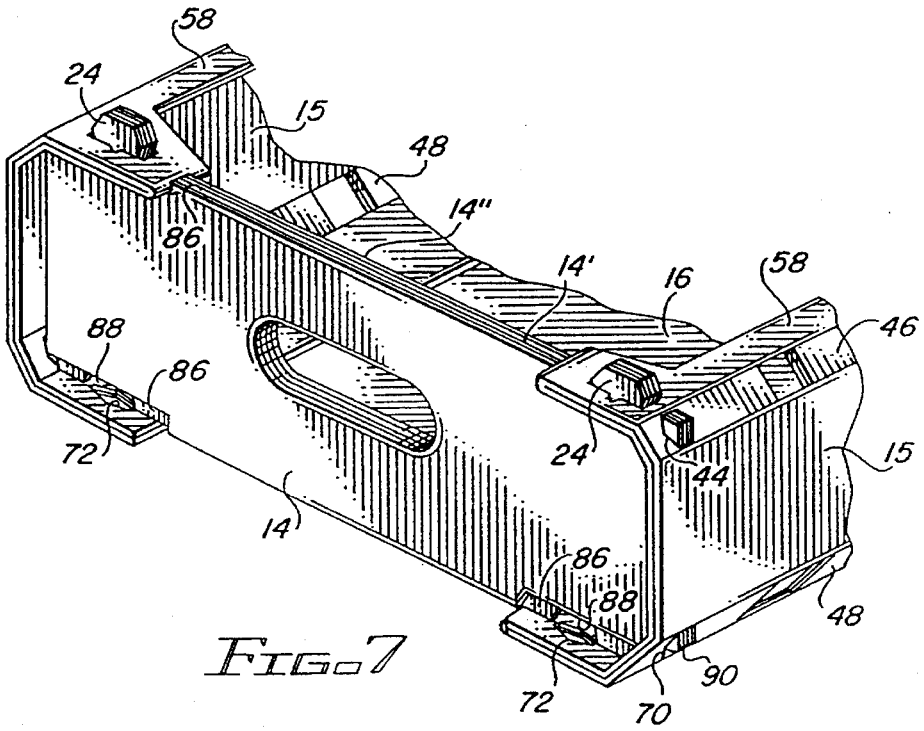
FIG. 7 is a partial pictorial view of a container embodying the modified arrangement of FIG. 5.

The stiffener insert 86 contains a handle opening 87 aligned with the handle openings of the end panel flaps and may be designed to extend down to the bottom panel for maximum strength. As illustrated in FIG. 7, with such an arrangement recesses 88 in the lower edge portion of the insert are aligned with the stacking openings 72 in the bottom panel and are in position to receive the stacking projections of the next lower container in a stack. Also, the upper and lower corners 89 and 90 of the insert extend into the end slots 44 and 70 of the upper and lower bevel panels to lend greater stability to the end panels. The insert may also include stacking projections 91 which become aligned with the stacking projections of the end panel flaps to stiffen the end panel projections as well as the main body of the end panel.

A blank for forming another modified container is shown in FIG. 8. In this arrangement the main body of the blank 92 is identical to the main body of the blank of FIG. 3, and the end panel flap 14 is similar to the end panel flap 14 of FIG. 3. Instead of two full reinforcement flaps connected to either end of the flap 14 as in FIG. 3, however, half-flaps 94 are connected by fold lines 96 to each end of the flap 14. Each half-flap is identical to half of the flaps 14' and 14" of FIG. 3. Connected to the stacking projections 24 by fold lines 98 are the stacking projections 100 of the flap 102. The flap 102 is similar to the shape of the insert 86 of FIG. 5 in that stacking recesses 104 are provided. When the end panels of the container are formed by first folding in the half-flaps 94 and then the flap 102 flat against them, the result is a three-ply end panel which includes stacking recesses 104 and upper and lower corners which fit into the end slots in the upper and lower bevel panels of the container.

Figure 6:
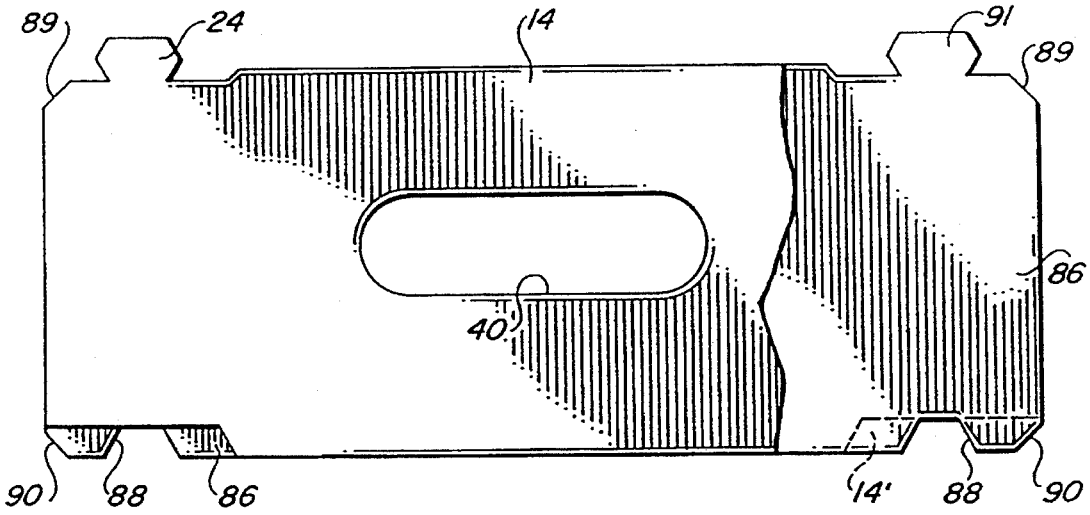
FIG. 6 is an elevation of the end panel of the modified arrangement, with a portion of the outer ply of the end panel removed to reveal the insert.

If desired, an insert of substantially the same size and shape as the flap 102 may be provided, as in the embodiment of FIGS. 5–7, in order to further strengthen the end panels.

Figure 9:
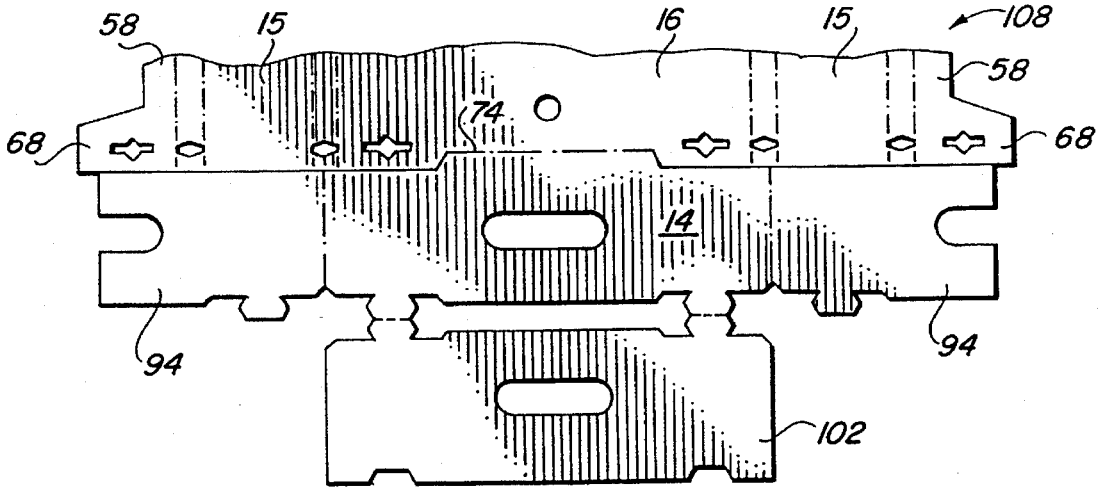
FIG. 9 is a partial plan view of a blank similar to that of FIG. 8 but which is designed to form a container having side panels of single-ply construction.

The containers described thus far have included side panels and bevel panels of two-ply construction. If it is determined that a container does not require the strength of a two-ply construction, the reinforcement sections 15', 58', 46', 48' and 64 may be eliminated and the container formed of single-ply construction. A blank 108 for forming such a container is shown in the partial view of FIG. 9 to be identical to the blank of FIG. 8, except that the ends of the blank are the ends of the locking tabs 68. This would not alter the method of forming the container, except for not having to fold and glue the reinforcing sections prior to wrapping the cover sheet around the formed end panels. Although the blank of FIG. 3 could also be modified to produce a single-ply container, such an arrangement would not be an efficient use of the stock from which the blank is cut inasmuch as the reinforcement end flaps would extend beyond the ends of the main body of the blank. No such limitation applies to the blank of FIG. 9, since the ends of the half-flaps 94 are within the boundaries of the ends of the main body of the blank.

Figure 10:
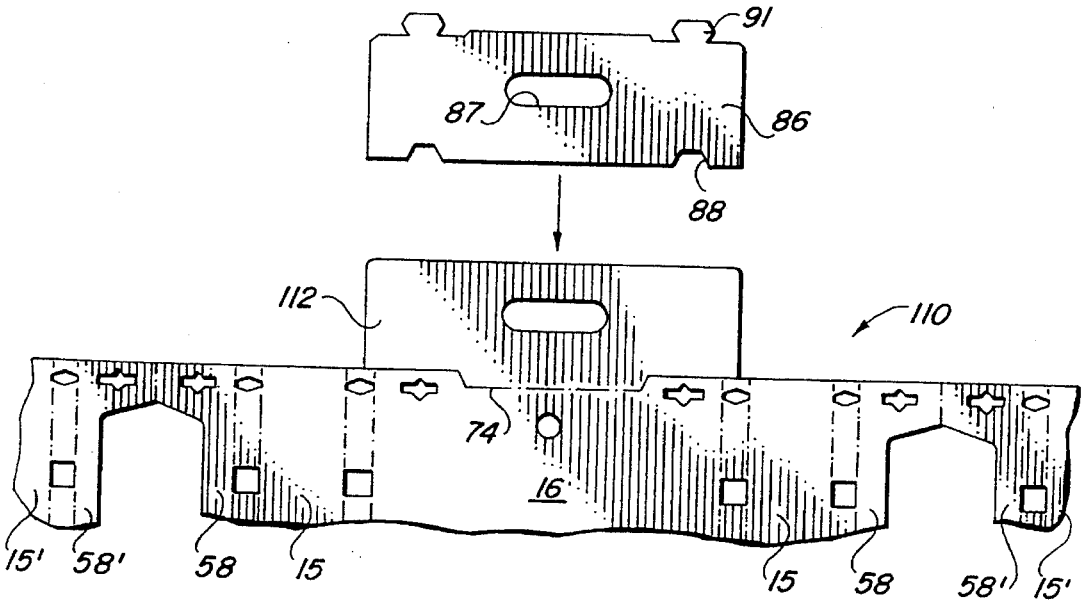
FIG. 10 is a partial plan view of a blank for forming a further modified container.

A blank 110 incorporating a further modified end panel arrangement is illustrated in FIG. 10 as having only a single end panel flap 112 connected to the bottom panel section 16 by the fold line 74. As in the flap 14 of FIG. 3, the flap 112 is recessed on either side of the fold line 74, which allows the cover sheet to extend beyond the end panels of the finished container. Since the end panel flap 112 is comprised of only a single ply of the cover sheet material, it is not capable of providing adequate stiffness and strength at the ends of the container. To strengthen the end panel construction a stiffener panel or rigid web 86, similar in shape to the insert 86 of FIG. 5, is aligned with the flap 112 and glued to the flap. No stacking projections are provided on the flap 112 since the thickness and rigidity of the stiffener panel are such that the stacking projections 91 of the panel are sufficient.

Figure 11:
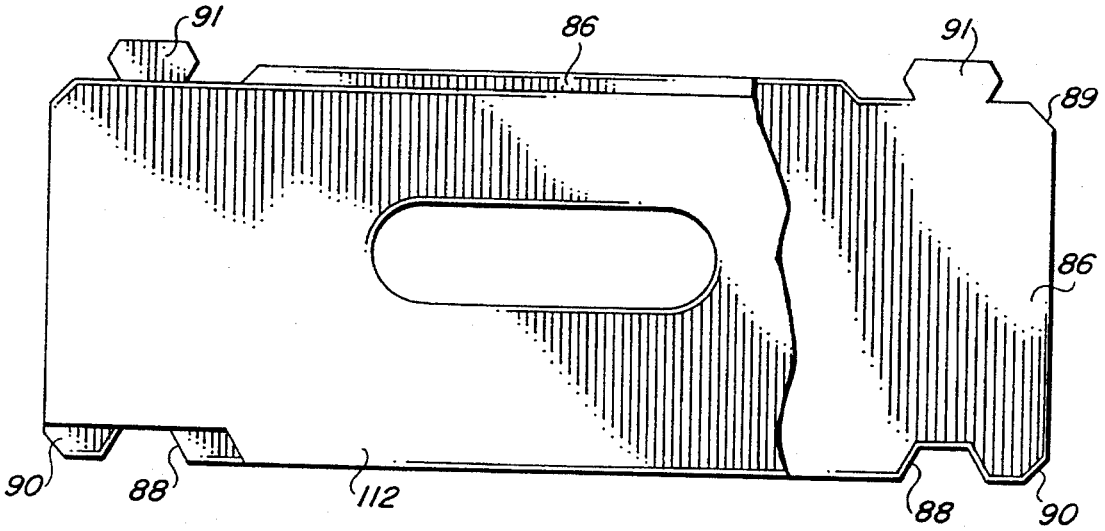
FIG. 11 is an elevation of the end panel of the container of FIG. 10, with a portion of the end flap of the cover sheet removed to reveal the insert.

As shown in the end view of FIG. 11, the recesses 88 in the lower edge portion of the stiffener panel 90 are aligned with the stacking projections 91 and are in position to receive the stacking projections of the next lower container in a stack, thereby facilitating the stacking process. Also, both the upper and lower corners 89 and 90 of the insert will extend into the end slots of the upper and lower bevel panels. This arrangement not only makes efficient use of the cover sheet blank material while providing adequate end panel strength, but makes it possible to provide a container which is more unified in appearance. The outer exposed face of the end panels is comprised of the flap 112, which is of the same material as the side panels. This makes it possible to provide printing or other indicia on the end panels as a continuation of, or addition to, other indicia which may appear on the side panels. Since the containers commonly are displayed in retail outlets, this is an important merchandising feature.

Although the container of the invention has been shown for the purpose of illustration as being comprised of a single bin formed by the space between the two end panels, it is within the scope of the invention to provide one or more interior cross panels to divide the container into multiple bins, if desired. It will be appreciated that the thickness of the various plies of material have been exaggerated in the drawing in order to illustrate their presence, and that the plies of an actual container would be substantially thinner relative to the other dimensions of the container.

In summary, the invention provides a container which can be formed from a single blank and which permits the end panels to be further stiffened as required by the strength demands of a particular container. The amount of paperboard required for the blank is minimized by the design, yet the cover sheet is securely held in place by the locking tabs.

It should be obvious that although preferred embodiments of the invention have been described, changes to certain details of the embodiments can be made without departing from the spirit and scope of the invention defined in the appended claims.

What is claimed is:

1. A container, comprising:

two spaced, substantially parallel, relatively rigid end panels;

each end panel having two spaced upper corner areas and two upwardly extending projections, each projection being inwardly spaced from one of the upper corner areas;

a flexible sheet forming bottom and side panels extending between the end panels;

each side panel including an upper inwardly sloped portion;

the upper corner areas of the end panels extending through slots in the upper sloped portions;

a top panel segment extending inwardly from each upper sloped portion;

means for securing the top panel segments to associated of said end panel projections; and each end panel including an end panel flap connected by a fold line to the bottom panel, the end panel flaps extending upwardly for substantially the entire height of the end panels.

2. A container as defined in claim 1, wherein each end panel includes a reinforcing ply foldably connected to said end panel flap.

3. A container as defined in claim 2, wherein each end panel includes a stiffener insert between the end panel flap and the foldably connected reinforcing ply.

4. A container as defined in claim 2, wherein each end panel flap and the reinforcing ply associated therewith include aligned projections.

5. A container as defined in claim 1, wherein each end panel includes two reinforcing plies and the end panel flap of each end panel includes opposite ends, one of the reinforcing plies of each end panel comprising a flap connected to one of the ends of the end panel flap associated therewith and the other reinforcing ply of each end panel comprising a flap connected to the other end of the end panel flap associated therewith, each reinforcing ply being substantially of the same shape and size as the end panel flap associated therewith.

6. A container as defined in claim 1, wherein each end panel includes two reinforcing plies and the end panel flap of each end panel includes an upper edge and opposite ends, one of the reinforcing plies of each end panel comprising a partial flap connected to one of the ends of the end panel flap associated therewith and a partial flap connected to the other end of said associated end panel flap, the other reinforcing ply of each end panel comprising a single flap having an upper edge connected to the upper edge of the end panel flap associated therewith, the reinforcing plies comprised of the partial flaps and the other reinforcing plies being substantially of the same shape and size as the end panel flaps.

7. A container as defined in claim 6, wherein the upper edge of each end panel flap and the upper edge of each associated single flap reinforcing ply include aligned spaced projections, the projections of the end panel flaps being foldably connected to the projections of the associated single flap.

8. A container as defined in claim 7, wherein the single flap reinforcing ply of each end panel includes projection recesses located opposite the projections.

9. A container as defined in claim 1, wherein each end panel is comprised of said end panel flap and a rigid web adhered thereto, the rigid web of each end panel including projections and oppositely located projection recesses.

10. A container as defined in claim 1, wherein the side panels and top panel segments include end edges, the end panels being inwardly recessed from said end edges.

11. A container as defined in claim 1, wherein the side panels and top panel segments are of two-ply construction.

12. A container as defined in claim 1, wherein the means for securing the top panel segments to the end panel projections associated therewith comprises slots in the top panel segments through which the projections associated therewith extend.

13. A blank for forming a container, comprising:

a centrally located bottom panel section;

side panel sections connected to opposite sides of the bottom panel section;

the side panel sections and adjacent portions of the bottom panel section having substantially aligned end edges;

a top panel segment connected to each side panel section;

each side panel section including an upper bevel section adjacent the associated top panel section;

end panel flaps connected to opposite ends of the bottom panel section along fold lines inwardly recessed from the aligned end edges of the bottom panel section and the side panel sections, the end panel flaps extending away from the bottom panel section for a distance substantially corresponding to the height of a container formed from the blank;

each end panel flap having two spaced upper corner areas;

slots in the upper bevel sections for receiving the upper corner areas of the end panel flaps in a container formed from the blank; and slots in the top panel segments for receiving end panel projections in a container formed from the blank.

14. A blank as defined in claim 13, including reinforcing flaps foldably connected to opposite ends of the end panel flaps.

15. A blank as defined in claim 14, wherein each reinforcement flap is of substantially the same shape and size as the connected end panel flap.

16. A blank as defined in claim 14, wherein the reinforcement flaps connected to opposite ends of each end panel flap substantially meet when folded inwardly, the blank also including an additional reinforcement flap foldably connected to each end panel flap along an edge opposite the edge connected to the bottom panel section.

17. A blank as defined in claim 14, wherein each end panel flap and the reinforcing flaps associated therewith include projections located so as to be aligned when the reinforcing flaps are folded inwardly.

18. A blank as defined in claim 16, wherein each end panel flap and the associated additional reinforcement flap include spaced projections, the projections of the end panel flaps being foldably connected to the projections of the associated additional reinforcement flaps.

19. A blank as defined in claim 18, wherein the additional reinforcing flaps include projection recesses located opposite the projections thereon.

* * * * *